US012729672B2

(12) United States Patent
Guariglia

(10) Patent No.: US 12,729,672 B2
(45) Date of Patent: Sep. 8, 2026

(54) INLET SILENCER FOR A VOLUMETRIC COMPRESSOR AND VOLUMETRIC COMPRESSOR EQUIPPED WITH IT

(71) Applicant: ATLAS COPCO AIRPOWER, NAAMLOZE VENNOOTSCHAP, Wilrijk (BE)

(72) Inventor: Daniel Guariglia, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 1 day.

(21) Appl. No.: 18/873,427

(22) PCT Filed: Jun. 2, 2023

(86) PCT No.: PCT/IB2023/055700
§ 371 (c)(1),
(2) Date: Dec. 10, 2024

(87) PCT Pub. No.: WO2023/242667
PCT Pub. Date: Dec. 21, 2023

(65) Prior Publication Data

US 2025/0369431 A1 Dec. 4, 2025

(30) Foreign Application Priority Data

Jun. 13, 2022 (BE) ..... 2022/5458

(51) Int. Cl.
*F04B 39/00* (2006.01)
*F01N 1/08* (2006.01)
*F04C 29/06* (2006.01)

(52) U.S. Cl.
CPC ..... *F04B 39/0061* (2013.01); *F01N 1/083* (2013.01); *F04B 39/0066* (2013.01);
(Continued)

(58) Field of Classification Search
CPC ..... F04B 39/0061; F04B 39/0066; F04B 39/0072; F04C 29/063; F04C 29/065; F01N 1/083
See application file for complete search history.

(56) References Cited

U.S. PATENT DOCUMENTS 2,239,549 A * 4/1941 Chipley ..... F01N 1/089 181/269
2,241,010 A * 5/1941 Chipley ..... F01N 13/007 417/540

(Continued)

FOREIGN PATENT DOCUMENTS

CN 2654411 Y * 11/2004
CN 104519779 A 4/2015

(Continued)

OTHER PUBLICATIONS

International Search Report for PCT/IB2023/055700 dated Aug. 21, 2023.

(Continued)

*Primary Examiner* — Christopher S Bobish
(74) *Attorney, Agent, or Firm* — Sughrue Mion, PLLC

(57) ABSTRACT

Inlet silencer for a volumetric compressor, characterized in that the inlet silencer (1) comprises a housing (2) having at least one inlet (3) and at least one outlet (4), wherein at least one partition wall (6) dividing the housing (2) into at least a first chamber (7) and a second chamber (8) is provided in the housing (2), wherein one chamber (7, 8) connects to the inlet (3) and one chamber (7, 8) connects to the outlet (4), wherein at least one opening (9) connecting both chambers (7, 8) is arranged in the partition wall (6).

16 Claims, 3 Drawing Sheets

(52) U.S. Cl.
CPC ..... *F04B 39/0072* (2013.01); *F04C 29/063* (2013.01); *F04C 29/065* (2013.01)

(56) References Cited

U.S. PATENT DOCUMENTS

| | | | | | |
|---|---|---|---|---|---|
| 3,276,202 | A * | 10/1966 | Wright | F01N 1/083 | 60/275 |
| 3,480,105 | A * | 11/1969 | Burris | F04B 39/0061 | 181/255 |
| 4,264,282 | A * | 4/1981 | Crago | F04B 39/0038 | 417/243 |
| 4,330,239 | A * | 5/1982 | Gannaway | F01N 1/089 | 181/403 |
| 4,589,516 | A * | 5/1986 | Inoue | F01N 13/1861 | 181/282 |
| 4,841,728 | A * | 6/1989 | Jean | F01N 1/089 | 181/266 |
| 4,890,691 | A * | 1/1990 | Ching-ho | F01N 1/085 | 181/272 |
| 4,911,262 | A * | 3/1990 | Tani | F01N 1/089 | 181/266 |
| 5,196,654 | A * | 3/1993 | DiFlora | F01N 1/089 | 181/255 |
| 5,332,872 | A * | 7/1994 | Ewanek | F04D 29/663 | 181/258 |
| 5,984,045 | A * | 11/1999 | Maeda | F01N 1/10 | 181/254 |
| 6,446,454 | B1 * | 9/2002 | Lee | F04B 39/0061 | 181/403 |
| 6,467,570 | B1 * | 10/2002 | Herold | F01N 1/02 | 181/269 |
| 6,547,032 | B2 | 4/2003 | Yoon et al. | | |
| 6,598,390 | B2 * | 7/2003 | Chang | F01N 1/24 | 181/254 |
| 6,790,012 | B2 * | 9/2004 | Sharp | F04B 39/066 | 417/313 |
| 7,219,764 | B1 * | 5/2007 | Forbes | F01N 1/085 | 181/272 |
| 7,549,511 | B2 * | 6/2009 | Marocco | F01N 1/08 | 181/275 |
| 8,016,071 | B1 * | 9/2011 | Martinus | F04B 39/0061 | 181/275 |
| 8,434,586 | B2 * | 5/2013 | Pawelski | F04C 29/065 | 181/175 |
| 9,404,499 | B2 | 8/2016 | Seibel et al. | | |
| 9,752,564 | B2 * | 9/2017 | Arceno | F04B 39/0072 | |
| 9,976,460 | B2 * | 5/2018 | Khan | F01N 13/14 | |
| 10,578,089 | B2 * | 3/2020 | Cain | F04B 39/0061 | |
| 11,326,586 | B2 * | 5/2022 | Milner | F04B 39/0055 | |
| 11,466,675 | B2 * | 10/2022 | Cain | F04B 35/04 | |
| 12,031,533 | B2 * | 7/2024 | Noh | F04B 53/004 | |
| 2009/0025564 | A1 | 1/2009 | Kuwabara | | |
| 2019/0277276 | A1 * | 9/2019 | Cain | F04B 49/06 | |
| 2020/0049142 | A1 | 2/2020 | Ren et al. | | |
| 2024/0426514 | A1 * | 12/2024 | Hakuta | F24F 13/24 | |

FOREIGN PATENT DOCUMENTS

| | | | |
|---|---|---|---|
| EP | 2549108 | B1 | 9/2017 |
| KR | 900002445 | Y1 * | 3/1990 |

OTHER PUBLICATIONS

Written Opinion for PCT/IB2023/055700 dated Aug. 21, 2023.
Belgian Search Report for BE 202205458 dated Jan. 23, 2023.

* cited by examiner

INLET SILENCER FOR A VOLUMETRIC COMPRESSOR AND VOLUMETRIC COMPRESSOR EQUIPPED WITH IT

CROSS REFERENCE TO RELATED APPLICATIONS

This application is a National Stage of International Application No. PCT/IB2023/055700 filed Jun. 2, 2023, claiming priority based on Belgium Patent Application No. 2022/5458 filed Jun. 13, 2022.

BACKGROUND OF THE INVENTION

Field

The present invention relates to an inlet silencer.

More specifically, the invention is intended for volumetric compressors.

Background

It is known that volumetric compressors generate pulsations, not only at their outlet when the compressed gas leaves the compressor in a discontinuous and nonuniform manner, but also at their inlet when the gas to be compressed is drawn in in a discontinuous and nonuniform manner. These pulsations cause unwanted sound nuisance.

This phenomenon is known and present in tooth compressors, piston compressors and, to a lesser extent, also in screw compressors.

Therefore, in the known compressors, an acoustic housing is arranged at the inlet, provided with baffles with an acoustic foam. Since the available space in the compressor has to be taken into account, whereby the presence of the inlet filter and the minimization of the pressure drop are additional limiting constraints, such acoustic housings are far from optimal.

In many cases, said baffles are a structural part of the compressor, and are not at all adapted to have sound dampening properties.

In other words: in many cases, a number of structural elements are added into the compressor itself to deflect or distort the flow path of the gas drawn in, optionally supplemented with acoustic foam in the hope of reducing unwanted pulsations in this way.

SUMMARY OF THE INVENTION

The present invention aims to provide a solution to at least one of the aforementioned and/or other disadvantages.

The object of the present invention is an inlet silencer for a volumetric compressor, wherein the inlet silencer comprises a housing having at least one inlet and at least one outlet, wherein at least one partition wall dividing the housing into at least a first chamber and a second chamber is provided in the housing, wherein one chamber connects to the inlet and one chamber connects to the outlet, wherein at least one opening connecting both chambers is arranged in the partition wall.

An advantage is that the inlet silencer is a reactive silencer, which will dampen or attenuate the pulsations and thus limit the sound nuisance.

In addition, the inlet silencer generates only a very limited pressure drop, for FAD (free air delivery or compressed gas output) of up to 140 litres per second.

Indeed, said at least one opening may effectively concern only one opening, but may also comprise two or more openings, which may or may not be grouped in the partition wall. For example, the partition wall could be provided with perforations over a portion of its surface.

In the simplest embodiment, the inlet silencer comprises one inlet, one outlet, one partition wall and a first chamber and a second chamber.

It is also possible, for example, that there are two inlets and one outlet and three chambers that are created by arranging two partition walls in the housing. In this case, two chambers will each connect to an inlet and the third chamber to the outlet.

Preferably, said at least one opening is arranged near a corner of the partition wall such that the distance between the at least one opening and said corner is smaller than the distance between the at least one opening and a centre of said partition wall.

Or, in other words, the at least one opening is not located centrally in the partition wall, but near a corner of the partition wall.

By arranging the opening near a corner, it will be possible to also efficiently dampen the higher order acoustic modes of the pulsations.

According to a preferred feature of the invention, a sound-absorbing material is arranged in the first chamber.

This sound-absorbing material can, for example, be arranged on the inner walls of the first chamber.

As a result, the silencer will also be a dissipative silencer. The combination of the two chambers with the sound-absorbing material creates a hybrid dissipative-reactive silencer.

As a result, the high frequencies can be dampened.

In a practical embodiment, the volume of the second chamber is at least 50% of the volume of the first chamber.

Due to this minimum volume of the second chamber, the low frequencies will also be efficiently dampened.

Moreover, this also makes the second chamber sufficiently large to provide space for an inlet filter.

Preferably, an inlet filter is arranged in the second chamber such that the gas entering the second chamber must pass through the inlet filter before it can leave the second chamber.

The integration of the inlet filter into the inlet silencer provides a space-saving integration, such that more room is left to maximize the housing size, such that the first and second chambers have the largest possible volume.

In a preferred embodiment, the total surface area of the at least one opening is larger than a particular value, such that the velocity of the gas through the at least one opening is at most 30 meters per second.

The precise dimensions are determined on the basis of the (operating) parameters of the compressor, from which follows a particular minimum value for the surface.

By limiting the speed of the gas via said at least one opening, the pressure drop can also be limited as much as possible.

In the other preferred embodiment, in the first chamber, at least one reversing plate or baffle is arranged crossing the geometrical line between the inlet and said opening, wherein the reversing plate or the baffle partially divides the first chamber into three sub-chambers such that an airflow flowing from the inlet to one of the at least one openings must flow around the reversing plate or the baffle.

Or, in other words: at least one opening, and preferably all openings, are, as it were, blocked or shielded by the reversing plate or the baffle from the airflow flowing through the inlet into the chamber.

This forces the gas to change direction of flow to pass through the chamber, which will help dampening the pulsations.

It is not excluded that several reversing plates or baffles are arranged in the first chamber. These are then preferably staggered, such that a kind of structure is formed wherein the gas has to reverse or bend its flow direction a number of times in order to flow through the chamber.

It is also possible that the reversing plate or the baffle divides the first chamber into only two sub-chambers or more than three sub-chambers.

In this case, the first chamber preferably has a tortuosity of maximally 2.5.

The tortuosity of the first chamber is defined as the fraction of, on the one hand, the length of the geometrical line from the inlet to the at least one opening, and on the other hand, the shortest flow path of the airflow through the first chamber around the at least one reversing plate or baffle.

In this case, the tortuosity always amounts to a value greater than unity.

By limiting the tortuosity of the first chamber to a value of maximally 2.5, a propagation of high frequency noise in the first chamber can be reduced by impeding a propagation of the higher order acoustic modes of the pulsations in the gas, while a pressure drop over the first chamber remains surprisingly low.

This is because the propagation of the higher order acoustic modes is impeded according to a reflective acoustic mechanism, and not according to a dissipative acoustic mechanism which would occur if the tortuosity of the first chamber is above 2.5.

The invention also relates to a volumetric compressor, characterized in that an inlet silencer according to any one of the preceding embodiments is arranged on the gas inlet of the volumetric compressor.

For example, the volumetric compressor is a tooth compressor, screw compressor, scroll compressor, lobe compressor, vane compressor or piston compressor.

It is obvious that the advantages of such a volumetric compressor are similar to the advantages of the inlet silencer.

BRIEF DESCRIPTION OF THE DRAWINGS

With the intention of better demonstrating the features of the invention, some preferred embodiments of an inlet silencer according to the invention for a volumetric compressor and of a volumetric compressor equipped therewith are described below, by way of example without any limiting character, with reference to the appended drawings, in which:

FIG. 3 represents another view of FIG. 1;

DETAILED DESCRIPTION OF THE INVENTION

Figure 1:
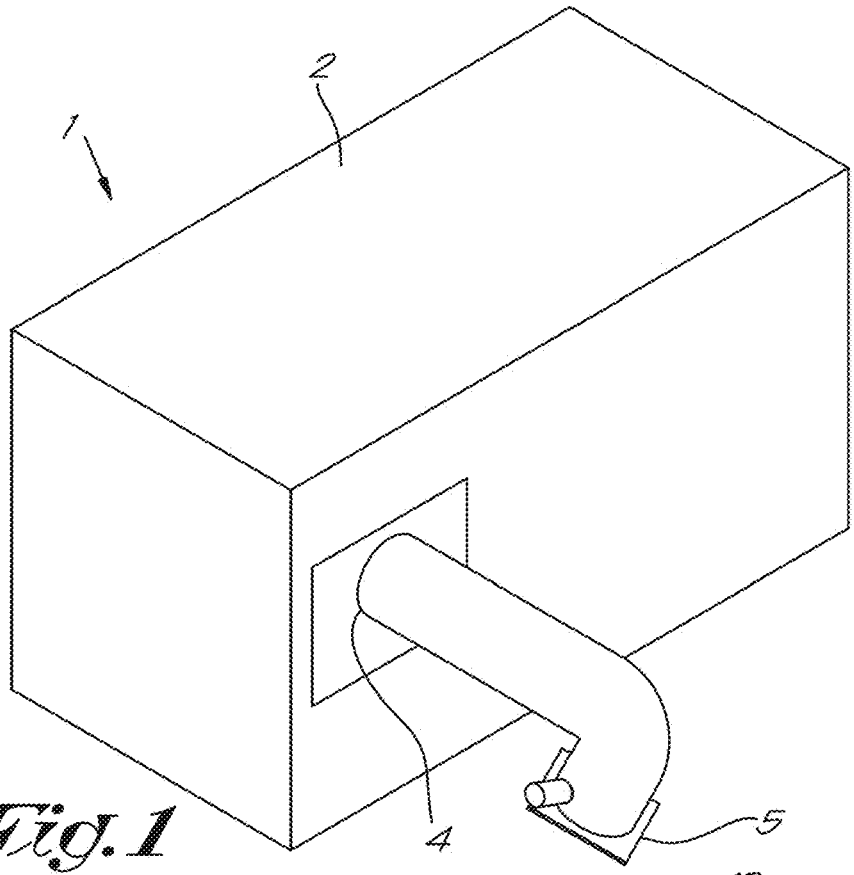
FIG. 1 schematically and in perspective represents an inlet silencer according to the invention.
Figure 2:
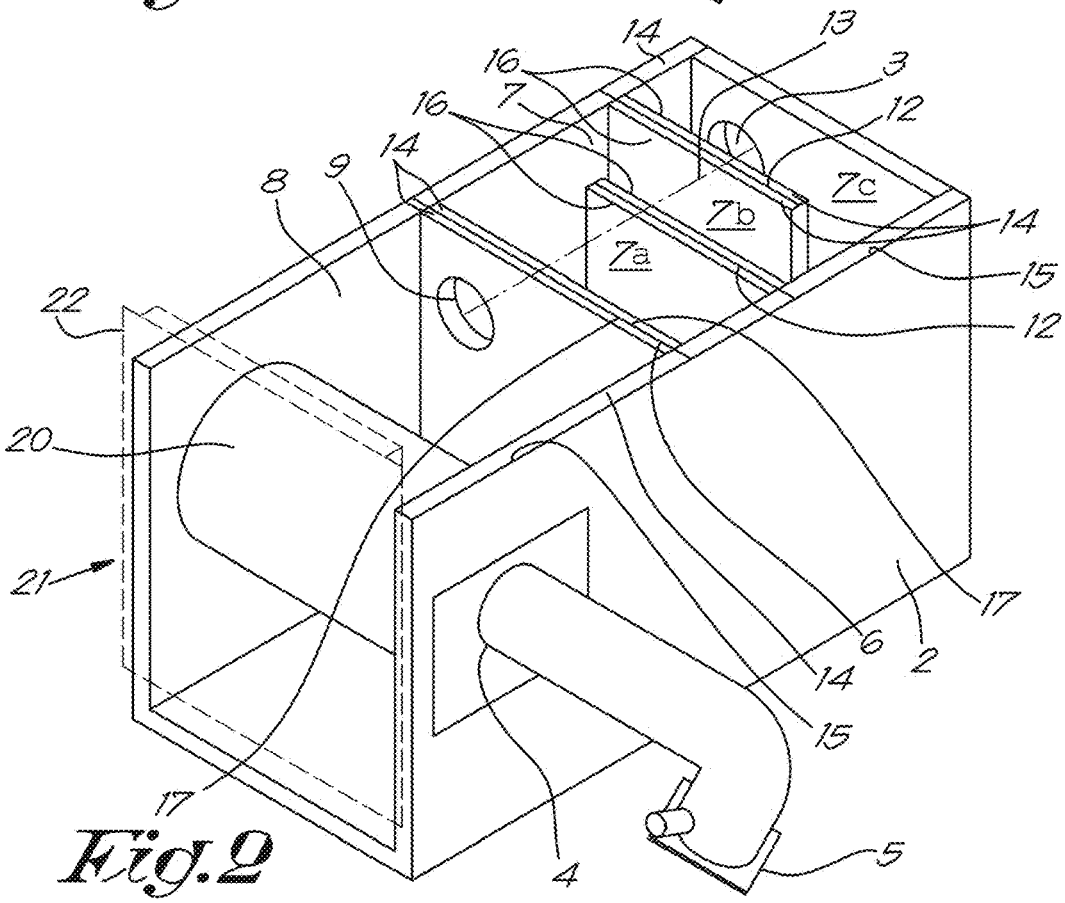
FIG. 2 represents the inlet silencer of FIG. 1, with the housing partially cut away.

The inlet silencer 1, schematically shown in FIGS. 1 and 2, mainly comprises a housing 2 with an inlet 3 and an outlet 4. The outlet 4 of the housing 1 can be connected to or attached to a gas inlet 5 of a volumetric compressor.

As can be seen in FIG. 1, in this case, the housing 2 is beam-shaped. Such shape allows for easy or better integration in a compressor canopy.

As can be seen in FIGS. 2 and 3, a partition wall 6 is arranged in the housing 2.

This partition wall 6 is impermeable to gas and divides the housing 1 into a first chamber 7 and a second chamber 8.

The division will be done such that one chamber 7, 8 connects to said inlet 3 and one chamber 7, 8 to said outlet 4.

In this case, the first chamber 7 will connect to the inlet 3 and the second chamber 8 to the outlet 4.

In this case, the volume of the second chamber 8 is equal to, or approximately equal to, the volume of the first chamber 7. Of course, the invention is not limited thereto. Preferably, the volume of the second chamber 8 is always at least equal to 50% of the volume of the first chamber 7.

At least one opening 9, which connects both chambers 7, 8, is arranged in the partition wall 6. In this case, one opening 9 is provided. However, it is possible that several openings 9 are provided in the partition wall 6.

The foregoing implies that the gas will flow through the inlet silencer 1 from the inlet 3, to the first chamber 7, through the opening 9, to the second chamber 8 and then to the outlet 4 to exit the inlet silencer 1.

It is also possible that the first chamber 7 connects to the outlet 4 and the second chamber 8 to the inlet 3. In this case, the gas will first flow through the second chamber 8 before entering the first chamber 7.

Figure 4:
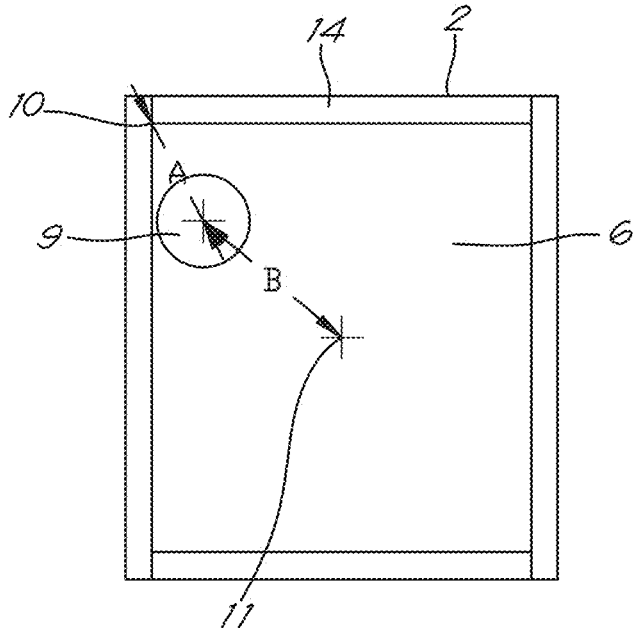
FIG. 4 represents a cross-section according to line IV-IV in FIG. 3.
Figure 5:
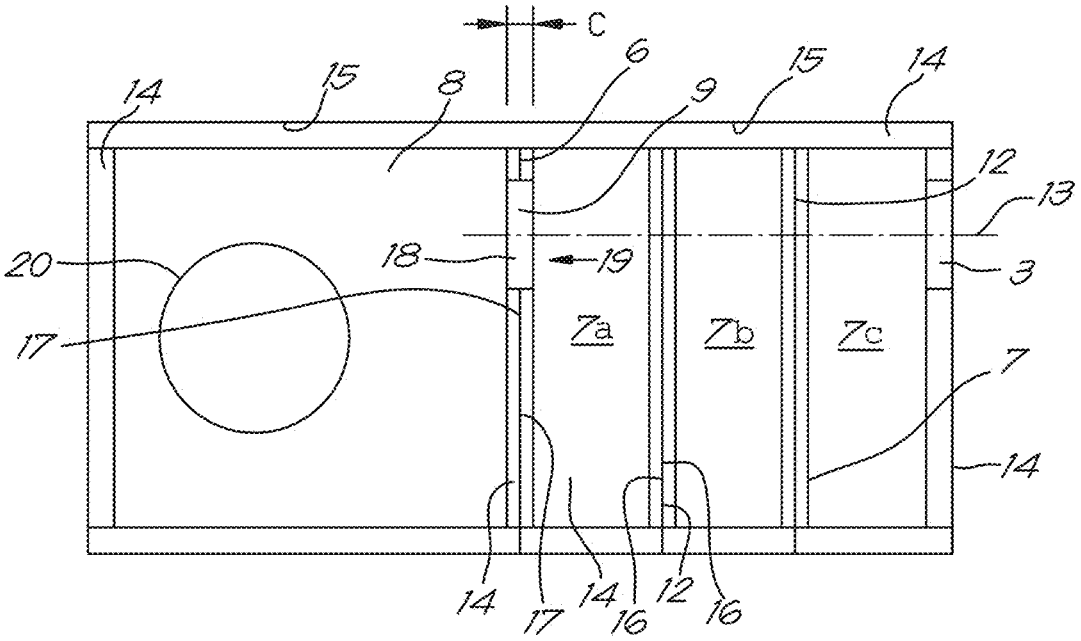

In this case, said at least one opening 9 is arranged near a corner 10 of the partition wall 6. This is clearly visible in FIG. 4.

The distance A between the at least one opening 9 and said corner 10 is smaller than the distance B between the at least one opening 9 and a centre 1 of the partition wall 6.

Or, in other words, the opening 9 is not centrally located in the partition wall 6.

The total surface area of the at least one opening 9 is larger than a particular value, such that the velocity of the gas through the at least one opening 9 is at most 30 meters per second.

Said particular value is determined on the basis of the (operating) parameters of the compressor to which the inlet silencer 1 will be connected.

Additional facilities are arranged in both the first chamber 7 and the second chamber 8.

In the first chamber 8, a reversing plate 12 or baffle is arranged. In this case, two reversing plates 12 or baffles are arranged.

The reversing plates 12 cross the geometrical line 13 between the inlet 3 and said opening 9, wherein the reversing plates 12 or the baffles partially divide the first chamber 7 into three sub-chambers 7*a*, 7*b*, 7*c* such that an airflow flowing from the inlet 3 to the opening 9 must flow around the reversing plates 12 or baffles.

This is schematically shown in FIG. 3 by means of arrows.

Sound-absorbing material 14 is arranged in the first chamber 7. In this case, sound-absorbing material 14 is also arranged in the second chamber 8.

In this case, the sound-absorbing material 14 is a permeable material, such as preferably polyurethane foam, melamine foam, viscoelastic foam, rock wool, glass wool or an acoustic cloth.

Figure 5:
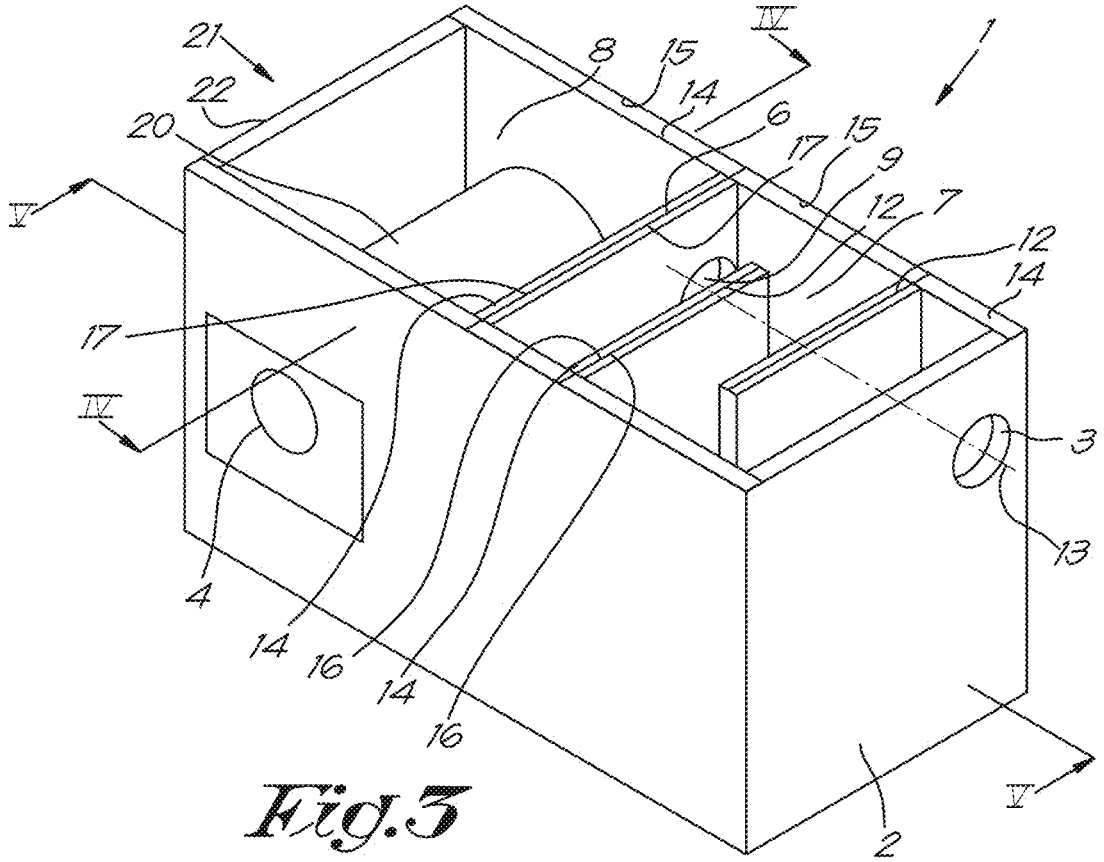
FIG. 5 represents the cross-section according to line V-V in FIG. 3.

The sound-absorbing material 14 is arranged on all inner sides 15 of the housing 2, as shown in FIG. 5, in both the first chamber 7 and the second chamber 8. It is also possible that the sound-absorbing material 14 is only arranged in the first chamber 7.

The sound-absorbing material 14 is also arranged on said two reversing plates 12 or baffles, and this on both sides 16. It is also possible that it is arranged to only one of the reversing plates 12 or baffles, or not on both sides 16 but only on one side 16.

The sound-absorbing material 14 is also arranged on at least one side 17 of the partition wall 6, and in this case on both sides 17 of the partition wall 6.

A passage 18 is provided in the sound-absorbing material 14 at the location of said opening 9, as it were, to form a channel 19.

The length C of this channel 19 corresponds to twice the thickness of the sound-absorbing material 14 and the thickness of the partition wall 9, as can be seen in FIG. 5.

This thus created channel 19 will provide additional dampening.

Such a channel 19 between the first chamber 7 and the second chamber 8 can also be realized in a different way.

The opening 9 in the partition wall 6 can, for example, be created by a pipe or conduit extending through the partition wall 6 or by a pipe or conduit being arranged in this opening 6, wherein the open ends of said pipe or conduit extend into the first chamber 7 and second chamber 8.

In this way, the length of the channel 19 can be chosen freely.

Of course, it is not excluded that more than one pipe or conduit is provided. Preferably, the at least one opening 9 in the partition wall 6 is created by at least one pipe or conduit extending through the partition wall 6 or that at least one pipe or conduit is arranged in this at least one opening 9, wherein the open ends of said pipe or conduit are situated in the first chamber 7 and second chamber 8.

Thus, for example, if several openings 9 are arranged in the partition wall 6, a pipe or conduit can be arranged for each of these openings 9.

In the second chamber 8, in addition to the sound-absorbing material 14, in this case, an inlet filter 20 is also arranged, such that the gas entering the second chamber 8 must pass through the inlet filter 20 before leaving the second chamber 8 via the outlet 4.

Because the second chamber 8 has a particular minimum size, there is room to arrange the inlet filter 20 in this second chamber 8. This integration allows to create additional space in the compressor canopy, such that the inlet silencer 1 can be designed larger.

Finally, in this case, the housing 2 is provided with a closable access 21 for removing or replacing said inlet filter 20.

In this case, this closable access 21 is realized by providing a removable wall 22 in the housing 2, or, in other words: portion of a wall 22 of the housing 1 is removable.

It is also possible, for example, to provide a flap or door in housing 1.

The operation of the inlet silencer 1 is very simple and as follows.

The outlet 4 of the inlet silencer 1 is connected to the gas inlet 5 of a volumetric compressor.

During the operation of the volumetric compressor, gas to be compressed, for example ambient air, will be drawn in by the compressor.

This will happen in a non-continuous or nonuniform manner, i.e. the flow rate or speed of the ambient air drawn in is not constant.

Ambient air will be drawn in through the inlet 3 of the inlet silencer 1.

The ambient air enters the first chamber 7, where the air flow along the reversing plates 12 is bent twice. This is shown schematically in FIG. 3 with arrows.

The ambient air will then make contact with the sound-absorbing material 14, which is arranged on all inner walls 15 of the housing 2 and on both sides 16 of the reversing plates 12. This will dampen the unwanted pulsations, in particular at the higher frequencies, and the sound that these pulsations cause.

When the ambient air reaches the partition 6, it will flow through the opening 9 to the second chamber 8. Due to the size of the opening 9, the ambient air will only have a speed of at most 30 meters per second. Due to the location of the opening 9 near a corner 10 of the partition wall 6, the higher order acoustic modes will be dampened.

In the second chamber 8, the lower frequencies will be dampened and the ambient air will flow through the air filter 20 before flowing via the outlet 4 of the inlet silencer 1 to the gas inlet 5 of the compressor.

For the sake of completeness, it is also mentioned here that the inlet silencer 1 will also have a dampening effect for sound waves that are sent from the gas inlet 5 of the compressor through the inlet silencer 1.

Although in the embodiment described above and shown in the figures there is always one inlet and one outlet, a first chamber and a second chamber, it is not excluded that there is more than one inlet and outlet and/or more than two chambers.

The present invention is by no means limited to the embodiments described as an example and shown in the figures, but an inlet silencer according to the invention for a volumetric compressor and volumetric compressor equipped therewith can be realized in all kinds of shapes and sizes without departing from the scope of the invention.

The invention claimed is:

1. An inlet silencer for a volumetric compressor, comprising:

a housing (2) having at least one inlet (3) and at least one outlet (4), wherein at least one partition wall (6) dividing the housing (2) into a first chamber (7) and a second chamber (8) is provided in the housing (2), wherein one chamber (7, 8) connects to the inlet (3) and one chamber (7, 8) connects to the outlet (4), wherein at least one opening (9) connecting both chambers (7, 8) is arranged in the partition wall (6), wherein, in the first chamber (7), at least one reversing plate (12) or baffle is arranged (7) crossing the geometrical line (13) between the inlet (3) and said opening (9), wherein the reversing plate (12) or the baffle partially divides the first chamber (7) into several sub-chambers (7*a*, 7*b*, 7*c*) such that an airflow flowing from the inlet (3) to one of the at least one openings (9) must flow around the reversing plate (12) or the baffle, and wherein, in the first chamber (7), a fraction of a linear distance of the geometrical line (13) between the inlet (3) and said opening (9) and a distance of a shortest flowpath from the inlet (3) to said opening (9) around the reversing plate (12) or the baffle is a maximum of 2.5, wherein an inlet filter (20) is arranged in the second chamber (8) such that the gas entering the second chamber (8) must pass through the inlet filter (20) before it can leave the second chamber (8), and wherein the reversing plate (12) or the baffle is provided only in the first chamber (7), among the first chamber (7) and the second chamber (8).

2. The inlet silencer according to claim 1, wherein the first chamber (7) connects to the inlet (3) and the second chamber (8) connects to the outlet (4).

3. The inlet silencer according to claim 2, wherein the housing (2) is provided with a closable access (21) for removing or replacing said inlet filter (20).

4. The inlet silencer according to claim 1, wherein sound-absorbing material (14) is arranged at least in the first chamber (7) or at least in the second chamber (8).

5. The inlet silencer according to claim 4, wherein the sound-absorbing material (14) is arranged on at least one side (17) of the partition wall (6), wherein a passage (18) is provided in the sound-absorbing material (14) at the location of said opening (9) to form a channel (19).

6. The inlet silencer according to claim 4, wherein the sound-absorbing material (14) is a permeable material including polyurethane foam, melamine foam, viscoelastic foam, rock wool, glass wool or an acoustic cloth.

7. The inlet silencer according to claim 1, wherein sound-absorbing material (14) is arranged on said reversing plate (12).

8. The inlet silencer according to claim 1, wherein said at least one opening (9) is arranged near a corner (10) of the partition wall (6) such that the distance (A) between the at least one opening (9) and said corner (10) is smaller than the distance (B) between the at least one opening (9) and a centre (11) of the partition wall (6).

9. The inlet silencer according to claim 1, wherein a volume of the second chamber (8) is at least 50% of a volume of the first chamber (7).

10. The inlet silencer according to claim 1, wherein a total surface area of the at least one opening (9) is larger than a particular value, such that a velocity of the gas through the at least one opening (9) is at most 30 meters per second.

11. The inlet silencer according to claim 1, wherein the housing (2) is beam-shaped.

12. The inlet silencer according to claim 1, wherein the at least one opening (9) in the partition wall (6) is created by at least one pipe or conduit extending through the partition wall (6) or that in this at least one opening (9) at least one pipe or conduit is arranged, wherein open ends of said pipe or conduit are situated in the first chamber (7) and second chamber (8).

13. A volumetric compressor provided with a gas inlet, wherein the volumetric compressor further comprises the inlet silencer (1) according to claim 1, which is arranged on the said gas inlet.

14. The volumetric compressor according to claim 13, wherein the compressor is a tooth compressor, screw compressor or piston compressor.

15. The inlet silencer according to claim 1, wherein the housing (2) is beam-shaped, wherein a volume of the second chamber (8) is at least 50% of a volume of the first chamber (7), wherein the inlet silencer is configured to output compressed gas at a maximum rate of 140 litres per second, and wherein a total surface area of the at least one opening (9) is at least a predetermined value such that a velocity of the gas through the at least one opening (9) is at most 30 meters per second.

16. The inlet silencer according to claim 1, wherein the first chamber is configured to dampen sound waves of a first frequency, and the second chamber is configured to dampen sound waves of a second frequency that is less than the first frequency.

* * * * *